US006105287A

United States Patent [19]

Williams

[11] Patent Number: 6,105,287

[45] Date of Patent: Aug. 22, 2000

[54] OUTDOOR DISPLAY SYSTEM

[76] Inventor: Gary Williams, 2411 Sharon Pl., Evansville, Ind. 47711

[21] Appl. No.: 09/050,232

[22] Filed: Mar. 30, 1998

[51] Int. Cl.[7] ..... G09F 19/00

[52] U.S. Cl. ..... 40/124.5; 40/718; 40/773

[58] Field of Search ..... 40/124.5, 718, 40/661.09, 760, 773

[56] References Cited

U.S. PATENT DOCUMENTS

| | | | |
|---|---|---|---|
| 482,237 | 9/1892 | Follenius | 40/124.5 |
| 1,904,738 | 4/1933 | Johnson | 40/124.5 |
| 1,966,922 | 7/1934 | Coleman | 40/124.5 |
| 2,332,217 | 10/1943 | Harner | 40/124.5 |
| 2,533,474 | 12/1950 | Koch | 40/773 X |
| 2,823,479 | 2/1958 | Zdanowski | 40/661.09 |
| 3,438,159 | 4/1969 | Bergener et al. | 40/124.5 X |
| 3,673,722 | 7/1972 | Robertson | 40/718 |
| 3,918,187 | 11/1975 | Vogele | 40/760 X |
| 4,259,381 | 3/1981 | Narita | 40/124.5 X |
| 4,761,903 | 8/1988 | Cantrell | 40/773 X |
| 4,914,842 | 4/1990 | Lieberman | 40/760 X |
| 4,993,177 | 2/1991 | Hudson | 40/760 X |
| 5,205,059 | 4/1993 | Doll | 40/718 |
| 5,533,288 | 7/1996 | Lambert | 40/773 X |
| 5,950,342 | 9/1999 | Suesholtz | 40/773 X |

*Primary Examiner*—Joanne Silbermann

*Attorney, Agent, or Firm*—Theresa Fritz Camoriano; Camoriano and Associates

[57] ABSTRACT

A photograph display assembly and method which has particular application for outdoor use in combination with memorials or tombstones. The design utilizes a double-sided acrylic tape to hermetically seal a covering lens and to affix a frame assembly to a wall. The particular frame structure and method disclosed may be used for various sizes of pictorial or other written displays. The frame assembly includes a compartment or recessed area for a silica gel packet. The method steps of the invention include appropriate surface cleaning and the overall design make be easily installed and used.

9 Claims, 1 Drawing Sheet

OUTDOOR DISPLAY SYSTEM

BACKGROUND AND OBJECTS OF THE INVENTION

The present invention is generally related to the outdoor display,arts and, in particular, to a novel frame assembly which may be readily applied to such items as stone memorial markers, brick, metal, glass and wood.

While disclosed as primarily for outdoor use, the principles set forth herein have applicability for indoor use as well.

Prior art outdoor display systems have required rather complex and costly installation means and procedures which typically require the talents of a skilled craftsman.

Such systems must also be securely weather-proofed to insure long-life and integrity of the item being displayed.

Accordingly, it is an object of the present invention to demonstrate an outdoor display system which may be economically manufactured and sold for widespread commercial appeal.

It is a further object of the invention to set forth an outdoor display design which may be readily installed without the use of complex methods or expensive tools.

It is also an object of the invention to show a novel weather-resistant design which provides a long life and attractive display for the overall unit.

It is a still-further object of the invention to provide a system wherein the principal attaching components are factory supplied for ease of installation by the user.

These and other objects and advantages of the invention will be apparent to those of skill in the art from the description which follows.

PRIOR ART PATENTS AND DESIGNS

U.S. Pat. No. 4,790,088 illustrates a memorial marker display system which uses a sealing system but does not include the novel ease of use and installation methods of the present invention.

Other designs which require attaching bolts and screws are also difficult to use in practice and require skilled personnel for the installation process.

In contrast, the present design includes features which enable easy installation and which result in a highly attractive and long-life display.

SUMMARY OF THE INVENTION

The design uses double-coated pressure sensitive tape on the back of a frame element.

Such tape is also used on a frame ledge element to allow easy placement of a covering lens piece.

By factory installing the attaching tape elements, the resulting design is easy to use and install by the consumer.

A silica gel drying and dehumidifying agent is placed within the unit to reduce condensation and provide an attractive display.

A cardboard template is provided with the system to enable correct sizing of the photograph or other item to be displayed and to provide a backing for the displayed article.

The use of cleaning and adhesion promoting compounds is also a part of the method of installation.

DESCRIPTION OF THE DRAWING FIGURES

DESCRIPTION OF A PREFERRED EMBODIMENT

Figure 1:
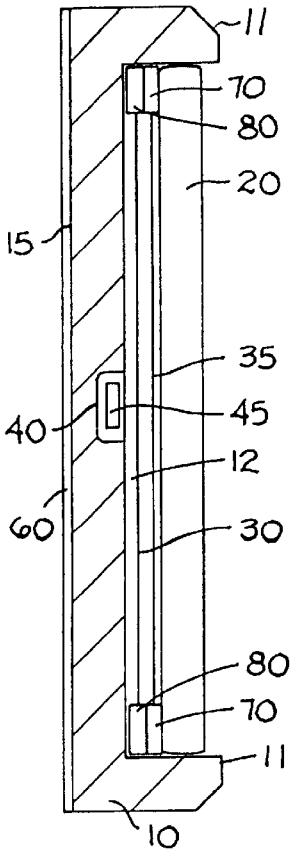
FIG. 1 shows a side cut-away view of the invention and shows the principal components utilized.

Referring to the side view of FIG. 1, the picture frame assembly 10 is shown as having a rear surface area 15 and a front surface area 12. Front surface 12 is recessed as defined by the edge extensions shown at numerals 11.

A ledge element 80 is formed within the edge extensions 11 and has double-coated tape 70 attached thereto for the purpose of mounting a lens element 20.

A cardboard backing and template element 30 and a photographic sheet 35 are positioned between the lens 20 and the front surface 12 of the frame.

The front surface 12 has a further recessed area or compartment 40 formed therein for the purpose of containing a silica gel packet 45 which serves as a dehumidifying agent for the overall assembly.

The rear surface 15 of the frame has double-coated tape 60 attached thereto for the purpose of mounting the frame assembly to a memorial or wall to be later shown and described.

Figure 2:
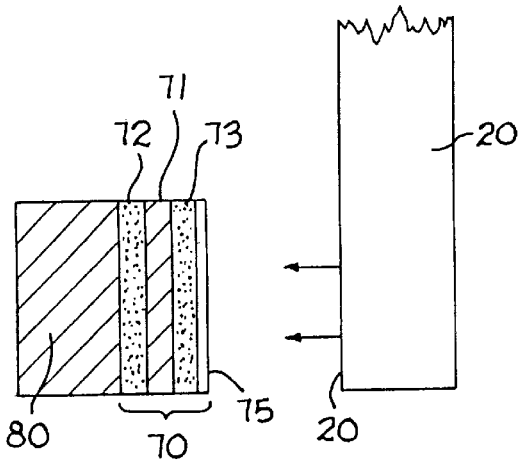
FIG. 2 shows an enlarged view of the double-coated acrylic foam tape as used in conjunction with the lens element.

The use of double-coated tape to mount lens 20 to ledge 80 is illustrated in FIG. 2.

As shown, the double-coated tape 70 comprises a mid-layer 71 and adhesive layers 72 and 73. It further includes a protective peel-off layer 75.

The adhesive layer 72 is factory applied to the ledge element 80, and the frame 10 and lens 20 with the tape 70 adhered to the ledge 80 may be supplied as a kit to be used by consumers".

In practice of the invention, after throughly cleaning the lens element 20, the protective tape layer 75 is removed and the lens 20 is simply pressure-applied to the ledge 80.

The lens cleaning may be achieved by using such compounds as isopropyl alcohol and a silane adhesion promoter.

Figure 3:
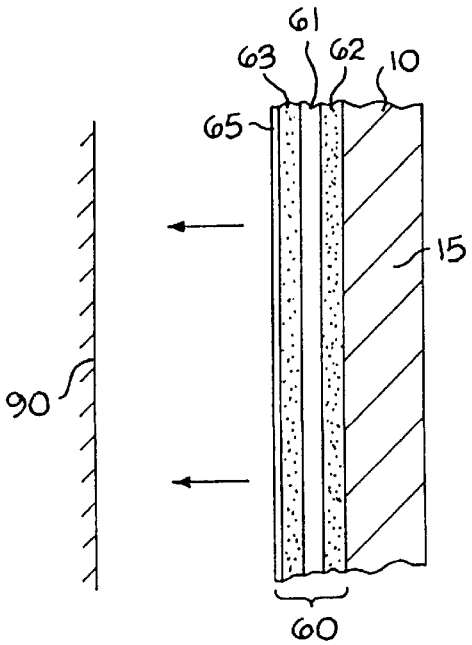
FIG. 3 shows an enlarged view of the double-coated acrylic foam tape as used in combination with the frame backing component of the design. The attachment to a wall or other surface is also schematically shown.

FIG. 3 illustrates, in similar fashion, how the overall unit 10 is mounted to a flat surface such as a memorial as indicated at numeral 90.

The double-coated tape 60 comprises a mid-layer 61 and adhesive layers 62 and 63 along with an outer peel-off layer 65.

As indicated in FIG. 3, the double-coated tape 60 is factory applied to the rear surface area of the frame 10.

Surface area 90, to which the frame is to be applied, is throughly cleaned using a compound such as the isopropyl alcohol and adhesion promoter previously noted.

The protective peel-off layer 65 is removed and the frame assembly 10 may then be pressure applied to the surface area 90.

The principles described herein may be adapted for use with virtually any size or shape of picture frame desired.

Figure 4:
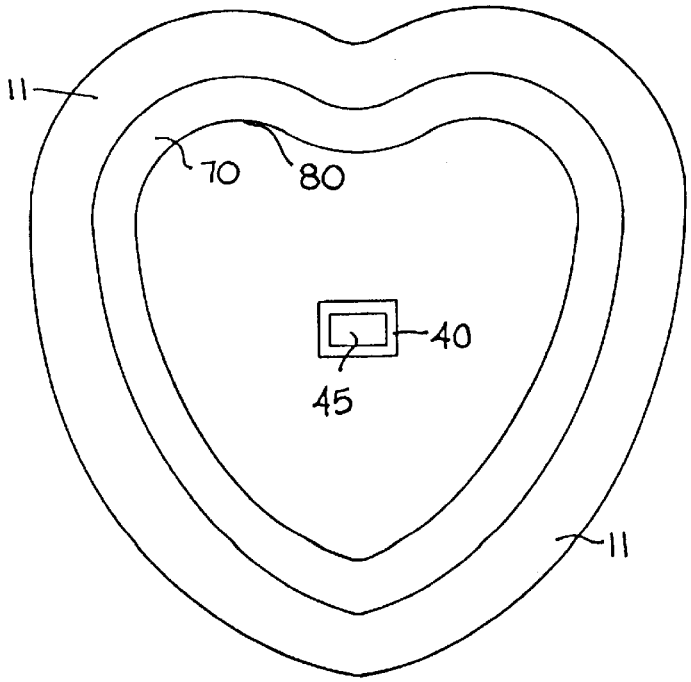
FIG. 4 shows a front view of a particular frame shape with the template sheet and photo sheet removed to illustrate the ledge position in relation to the overall unit.

FIG. 4, for example, shows a front view of a heart-shaped frame with the template sheet and the photo sheet removed to illustrate the ledge mounting feature and the silica gel compartment.

The materials used for the overall frame assembly 10 may comprise plastics, metals, wood or other materials known in the framing arts.

The lens element 20 may be comprised of Ultra-violet resistive materials to prevent sunlight deterioration to the photographic or display sheet 35.

From the foregoing apparatus description, it will be apparent that one method of installing the frame on a flat surface such as a memorial would comprise the following steps:

placing the silica gel packet in its appropriate compartment, cutting the photograph 35 using the template pattern 30 and placing both within the frame, cleaning the lens element 20 with the appropriate solution as noted previously, removing the tape protective film 75 from the ledge tape 70 and applying the lens to the ledge 80 via the adhesive layer 73(FIG. 2), cleaning the surface area 90 to which the frame is to be applied and removing the protective layer 65 from the tape 60(FIG. 3), applying the frame to surface 90 via the tape adhesive layer 63(FIG. 3).

The above method steps may be varied depending upon the particular conditions encountered or by choice of the installer as desired.

From the above apparatus and method of installation descriptions, it will be apparent that a long-life and easy-to-install frame assembly has been shown and illustrated.

While a particular design and method have been shown and described, it is intended in this specification to broadly cover all equivalent designs and methods which would reasonably occur to those of skill in the art.

The invention is further defined by the claims appended hereto.

I claim:

1. A frame kit, comprising:

a frame element, having a flat rear surface; a recessed front surface; a ledge extending forward of and surrounding said recessed front surface; and an edge extension extending forward of and surrounding said ledge;

a first double-coated adhesive tape adhered to the front surface of said ledge, with a first protective peel-off film layer on the front surface of said first double-coated adhesive tape; and a lens element, shaped to fit inside said edge extension and to be adhered to the front surface of said ledge upon removal of said protective peel-off film layer;

wherein a user may insert a photograph or other display against said recessed front surface, remove said protective film layer, and press said lens element against said adhesive tape to form a sealed, weatherproof display, which may then be mounted on an outdoor support, such as a tombstone.

2. A frame kit as recited in claim 1, and further comprising a second double-coated adhesive tape adhered to said flat rear surface, and a second protective peel-off film layer on the rear surface of said second adhesive tape, wherein a user may remove said second protective film layer to adhere said frame element to a flat surface, such as a tombstone.

3. A frame kit as recited in claim 1, and further comprising a template, having the dimensions of said recessed front surface, which can be used to cut a photograph to the correct shape to fit into the frame.

4. A frame kit as recited in claim 1, wherein said recessed front surface defines a second recess; and further comprising a dehumidifying packet sized to fit in said second recess.

5. A frame kit as recited in claim 1, wherein said frame element is formed in the shape of a heart.

6. A frame kit, comprising:

a frame element, having a flat rear surface; a recessed front surface; a continuous ledge extending forward of and surrounding said recessed front surface; and an edge extension extending forward of and surrounding said ledge;

a first double-coated adhesive tape adhered to the front surface of said continuous ledge, with a first protective peel-off film layer on the front surface of said first double-coated adhesive tape;

a lens element, shaped to fit inside said edge extension and to be adhered to the front surface of said ledge upon removal of said first protective peel-off film layer; and a template, having the shape of said recessed front surface;

wherein a user may cut a photograph to the shape of said template, insert the photograph against said recessed front surface, remove said first protective film layer, and press said lens element against said continuous adhesive tape to form a weatherproof, sealed display, which may then be mounted on an outdoor support, such as a tombstone.

7. A frame kit as recited in claim 6, and further comprising a second double-coated adhesive tape adhered to said flat rear surface, and a second protective peel-off film layer on the rear surface of said second adhesive tape, wherein a user may remove said second protective film layer to adhere said frame element to a flat surface, such as a tombstone.

8. An assembled frame, comprising:

a frame element, having a front surface including a recessed portion and an edge extension extending forward of and surrounding the recessed portion;

a lens element fitted inside said edge extension and having a periphery;

a double stick tape between the lens element and the front surface of the frame element, said double stick tape extending completely around the periphery of the lens element, adhering the lens element to the frame element and forming a weatherproof seal between said lens and said frame element, so that said assembled frame may then be mounted on an outdoor support, such as a tombstone.

9. A frame as recited in claim 8, and further comprising a second double-coated adhesive tape adhered to said flat rear surface, and a protective peel-off film layer on the rear surface of said second adhesive tape, wherein a user may remove said protective film layer to adhere said frame element to a flat surface, such as a tombstone.

* * * * *